United States Patent [19]

Okada et al.

[11] 4,330,033

[45] May 18, 1982

[54] CONSTANT PRESSURE TYPE EBULLIENT COOLING EQUIPMENT

[75] Inventors: Sadayuki Okada, Katsuta; Hisao Sonobe, Naka, both of Japan

[73] Assignee: Hitachi, Ltd., Tokyo, Japan

[21] Appl. No.: 127,391

[22] Filed: Mar. 5, 1980

[30] Foreign Application Priority Data

Mar. 5, 1979 [JP] Japan ..... 54-24470

[51] Int. Cl.[3] ..... F28D 15/00

[52] U.S. Cl. ..... 165/104.27; 336/58; 357/82; 361/385

[58] Field of Search ..... 165/105, DIG. 24, 104.27; 336/58; 357/82; 361/385; 174/15 HP

[56] References Cited

U.S. PATENT DOCUMENTS 3,989,102 11/1976 Jaster et al. ..... 361/385 X 4,106,557 8/1978 Sonobe et al. ..... 361/385 X 4,253,518 3/1981 Minesi ..... 336/58 X

*Primary Examiner*—Albert W. Davis

*Attorney, Agent, or Firm*—Craig & Antonelli

[57] ABSTRACT

A constant pressure type ebullient cooling equipment has a liquid receiver at a position higher than a condenser. The liquid receiver is connected with a vaporizer containing a liquid refrigerant by a coupling pipe. A valve and a device for opening or shutting the valve are disposed at an upper part of the liquid receiver. When refrigerant vapor produced in the vaporizer is introduced into the condenser, refrigerant liquid in the vaporizer moves to the liquid receiver. The condenser and the liquid receiver are connected by a deaerating pipe. Non-condensable gases such as air contained in the cooling equipment and the refrigerant enter the liquid receiver, and are emitted through the valve. As a result, the interior of the cooling equipment is held under a substantially constant pressure.

4 Claims, 3 Drawing Figures

CONSTANT PRESSURE TYPE EBULLIENT COOLING EQUIPMENT

This invention relates to a constant pressure type ebullient cooling equipment which cools a heating unit with the latent heat of vaporization by exploiting the ebullition and condensation of a refrigerant.

Ebullient cooling equipments are utilized in a commutator for railway vehicles, a circuit chopper for subway electric cars, a rectifier in a substation, etc. in the form of cooling, for example, semiconductor devices. A conventional ebullient cooling equipment consists principally of a vaporizer and a condenser, and forms a closed cooling vessel. The internal pressure of the cooling vessel varies depending upon the temperature of the refrigerant, which in turn varies greatly depending upon changes in the ambient temperature and the quantity of heat generation of the heating unit. For example, in case where freon-113 (trichlorotrifluoroethane) is used as the refrigerant and where the temperature of the refrigerant changes from 0° C. to 100° C., the internal pressure varies from 0.15 $Kg/cm^2$ to 4.5 $Kg/cm^2$ (absolute pressure). When, under such situation of use, the gastightness of the cooling vessel is imperfect and the internal pressure is lower than the atmospheric pressure (1.033 $Kg/cm^2$ in an absolute pressure), non-condensable gases such as air invade the cooling vessel to degrade the performance of the condenser and to make it impossible to attain a required cooling performance, so that the abnormal overheat and failure of the heating unit occur. Also when the internal pressure is higher than the atmospheric pressure, the refrigerant leaks out of the cooling vessel and dissipates, so that the cooling becomes impossible and that the same result as in the case where the internal pressure is below the atmospheric pressure is incurred.

In the conventional equipment, accordingly, it is an important subject to maintain the gastightness of the equipment. A completely welded assembly, structure, etc. are, therefore, adopted, but it is difficult to perfectly maintain the gastightness. Especially for large-sized cooling vessels, it is next to impossible to maintain the gastightness, and strong structures are required because the structures are treated as pressure vessels according to standard regulations. In addition, since the welded parts of the cooling equipment cannot be made truly gastight, very small quantities of non-condensable gases invade the equipment with secular changes, and an air reservoir needs to be disposed so as to achieve a predetermined cooling performance even after the invasion. Moreover, the welded parts, etc. need to be cut open in order to expose the interior of the cooling vessel, and the maintenance and inspection of the heating unit, etc. are very difficult.

U.S. Pat. No. 3,682,237 discloses cooling equipment provided with a bag which temporarily stores non-condensable gases such as air in order to secure a condensing space within a condenser. This prior art teaches a structure including a cooling vessel which is composed of at least a vaporizer and the condenser, a bag which is expansible and contractible, and coupling pipes which connect the bag and the cooling vessel. With this structure, when a predetermined ebullient cooling is executed, refrigerant vapor produced in accordance with the quantity of heat generated by a heating unit and the non-condensable gases contained therein move into the bag and stretch the expansible part of the bag freely, with the result that the condensing space of the condensing portion is secured. That is, it is intended to automatically vary the cooling performance in correspondence with the quantity of heat generation, thereby cooling the heating unit while holding the temperature of the refrigerant liquid at the boiling point and holding the internal pressure of the cooling equipment equal to the atmospheric pressure at all times. In the prior art structure, however, the bag and the condensing portion are at the same level, and only the refrigerant vapor enters the bag at all times. When the heat load in the vaporizer is great, the refrigerant vapor enters the condenser and the non-condensable gases contained in the refrigerant enter the bag. However, when the heat load becomes small and the vapor in the condensor lessens, the non-condensable gases return into the condenser again and the cooling performance is degraded. The prior art does not teach any concrete means for properly emitting the non-condensable gases.

An object of this invention is to provide a constant pressure type ebullient cooling equipment in which non-condensable gases such as air within the cooling equipment and air dissolved in a refrigerant are emitted out of the equipment during an ebullient cooling operation, so that good cooling performance can be always attained substantially under the atmospheric pressure.

In order to accomplish this object, the constant pressure type ebullient cooling equipment according to this invention comprises a vaporizer which is filled up with a refrigerant, a condenser which condenses refrigerant vapor produced in the vaporizer, a liquid receiver which is located above the condenser and which serves to receive refrigerant liquid when the refrigerant vapor exists in the condenser, coupling pipes which, respectively, connect the vaporizer and the condenser, and the vaporizer and the liquid receiver, and a valve which is located at an upper part of the liquid receiver and which serves to discharge non-condensable gases having gathered in the liquid receiver. More specifically, the non-condensable gases developing from the refrigerant liquid during its ebullition owing to the generation of heat from a heating unit are accumulated in the upper part of the liquid receiver, and when the quantity of the gases has exceeded a predetermined amount, the position of an expansible portion of the liquid receiver is detected and the non-condensable gases are emitted to the exterior. Thus, while holding or maintaining the pressure inside the cooling equipment substantially at the atmospheric pressure at all times, the non-condensable gases in the equipment can be readily emitted.

Figure 1:
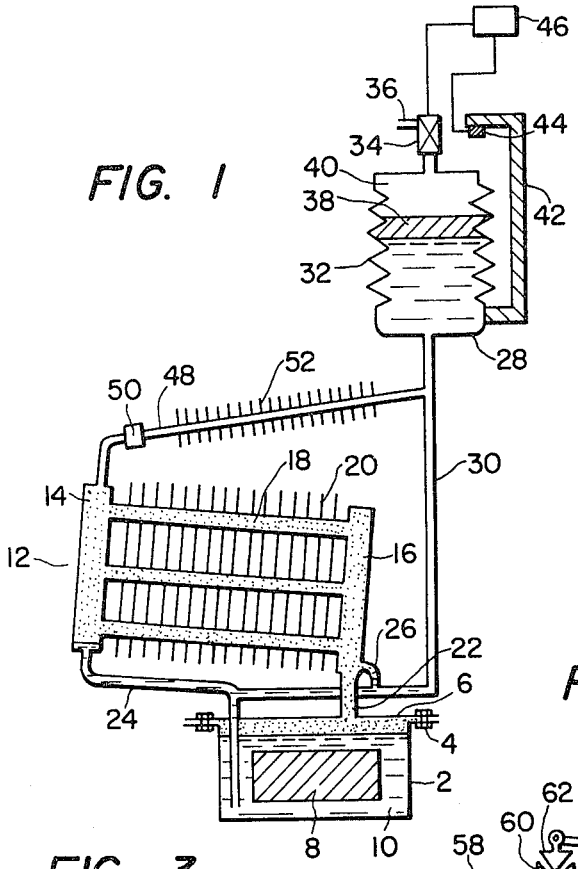
FIG. 1 is a sectional view showing an embodiment of a constant pressure type ebullient cooling equipment according to this invention.

Hereunder, an embodiment of this invention will be concretely described with reference to FIG. 1. In FIG. 1, a vaporizer 2 is tightly closed by a lid 6 and bolts 4. A semiconductor device 8, as a heating unit, is immersed in a liquid refrigerant 10 of, for example, trichlorotrifluoroethane, trichloropentafluoropropane or fluorocarbon contained in the vaporizer 2. A condenser 12 is provided at both its ends with headers 14 and 16, which are placed in communication by means of condensing tubes 18. Radiation fins 20 are mounted on the condensing tubes 18 so as to radiate heat into the open air. A vapor pipe 22 introduces vapor resulting from boiling within the vaporizer 2, into the condenser 12. The vapor pipe 22 also couples header 16 and the vaporizer 2. A liquid return pipe 24 connects the other header 14 and the bottom part of the vaporizer 2. Most of the liquid refrigerant condensed while the refrigerant vapor moves from the header 16 through the condensing tubes 18 to the header 14 returns to the vaporizer 2 through the liquid return pipe 24. Part of the liquid refrigerant comes back to the header 16 again along the inner walls of the condensing tubes 18 and then returns from the lower end of the header 16 through liquid return pipes 26 and 24 into the vaporizer 2.

A liquid receiver 28 is disposed above the condenser 12. A pipe 30 connects the bottom part of the liquid receiver 28 and the liquid return pipe 24. The liquid receiver 28 is provided with an expansion portion 32 which is freely expansible or contractible with a slight pressure, such as metal bellows. A valve 34 is disposed above the liquid receiver 28, and it is provided with an exhaust pipe 36. Usually, when the heating unit 8 is generating heat to fill up the condenser 12 with the refrigerant vapor, that quantity of the liquid refrigerant which is equal to a volume occupied by the vapor is received in the liquid receiver 28. The received liquid refrigerant is overlaid with a sealing liquid 38 having a specific gravity lower than that of the refrigerant and not dissolving in the refrigerant, for example, tetraethylene glycol liquid, with the result that an air chamber 40 with some volume is defined in the upper part of the liquid receiver 28. On the other hand, when the heating unit 8 is not generating heat, most of the liquid refrigerant within the liquid receiver 28 fills the condenser 12, so that the expansion portion 32 of the liquid receiver 28 contracts and that the sealing liquid 38 descends to and stops at the bottom part of the liquid receiver 28.

At the upper end of a stanchion 42 fixed outside the liquid receiver 28, a limit switch 44 is disposed. A power supply device 46 is connected to the valve 34 and the limit switch 44. When the upper end part of the liquid receiver 28 has come in contact with the limit switch 44, the switch 44 closes a circuit that sends a signal to the power supply device 46 so as to open the valve 34. Then, air within the liquid receiver 28 is emitted to the exterior through the exhaust pipe 36.

A deaerating pipe 58 places the header 15 of the condenser 12 and the coupling pipe 30 in communication. In intermediate positions of the pipe 48, a throttle 50 and a large number of radiation fins 52 are disposed. Desirably, the pipe 48 is inclined so that air bubbles may flow towards the coupling pipe 30 as viewed from the header 15. Regarding the relationship between the throttle 50 and the radiation fins 52, the throttle 50 must have a resistance allowing to pass only the refrigerant vapor in such an amount that when only the refrigerant vapor has passed through the throttle 50, it can be fully condensed to the liquid refrigerant while traveling in the part of the pipe 48 corresponding to the radiation fins 52. That is, the refrigerant vapor having passed through the throttle 50 is condensed, and only non-condensable gases stay in the air chamber 40 inside the liquid receiver 28.

The operation of the embodiment constructed as shown in FIG. 1 is as follows: In case where the heat generation of the heating unit 8 is null, i.e. insignificant, no boiling occurs in the vaporizer 2, and there is no refrigerant vapor. Therefore, the vaporizer 2, the condenser 12, the liquid return pipe 24 and the coupling pipe 30 are filled with the liquid refrigerant. The expansion portion 32 of the liquid receiver 28 contracts into a small volume, and the sealing liquid 38 contained therein stands still substantially in the bottom part of the liquid receiver 28. At this time, the internal pressure of the cooling equipment is the atmospheric pressure.

When, owing to the generation of heat from the heating unit 8, the temperature of the liquid refrigerant in the vaporizer 2 has become nearly at the boiling point thereof, boiling commences. The refrigerant vapor thus produced enters the header 16 of the condenser 12 from the vapor pipe 22, and is cooled in the condensing tubes 18 by the radiation fins 20. The greater part of the refrigerant condensed in the condensing tubes 18 returns to the vaporizer 2 via the header 14 as well as the liquid return pipe 24, and the remainder returns to the vaporizer 2 through the liquid return pipe 26 or the vapor pipe 22 via the lower end of the header 16 again, to form the cycles of the refrigerant. Meanwhile, the heating unit 8 is cooled. At this time, the refrigerant liquid corresponding to a volume occupied by the refrigerant vapor in the condenser 12 moves to the liquid receiver 28 through the coupling pipe 30, a balance is held with the expansion portion 32 stretched upwards, and the ebullient cooling is being executed in the state in which the interior of the cooling equipment is under the atmospheric pressure.

If the refrigerant does not contain any non-condensable gas such as air, the refrigerant vapor will not contain the air, either, so that the vapor fed from the header 14 into the pipe 48 little by little will be entirely condensed in the part of the radiation fins 52 after having passed through the throttle 50. The resulting refrigerant liquid will come back into the vaporizer 2 through the coupling pipe 30.

In contrast, in case where the heat generation is performed with a refrigerant containing air in large quantities immediately after the cooling equipment has been assembled or after the heating unit 8 has been replaced on account of breakdown or the like, large quantities of air are contained as a non-condensable gas in the refrigerant vapor. The air and the refrigerant vapor having gathered in the top part of the header 14 pass through the interior of the pipe 48. As stated previously, the refrigerant vapor is cooled and condensed by the radiation fins 52 and then returns to the vaporizer 2. Only the air passes through the interior of the pipe 48 in the form of air bubbles and ascends in the coupling pipe 30, whereupon it enters the liquid receiver 28, passes through the refrigerant liquid as well as the sealing liquid 38 and stays in the air chamber 40.

At the initial stage of the running of the cooling equipment, the volume of the air chamber 40 increases because the amount of air is large. When the expansion portion 32has expanded beyond a predetermined volume, the upper end part of the liquid receiver 28 comes in touch with the limit switch 44 mounted on the stanchion 42, with the result that a signal is generated. On the basis of this signal, the power supply device 46 opens the valve 34 to emit the air. After the predetermined volume of air has been emitted, the valve 34 is shut again. This operation is repeated. In case of freon refrigerants, approximately 0.1 to 0.2 weight-% of air is usually contained, which signifies that the quantity of air is two to three times larger than the quantity of the refrigerant liquid. It is only at the initial stage that the above-described deaeration is frequently performed. After the refrigerant liquid has been deaerated repeatedly several times, the ebullient cooling is carried out in the state in which the sealing liquid stands low in liquid receiver 28.

Figure 2:
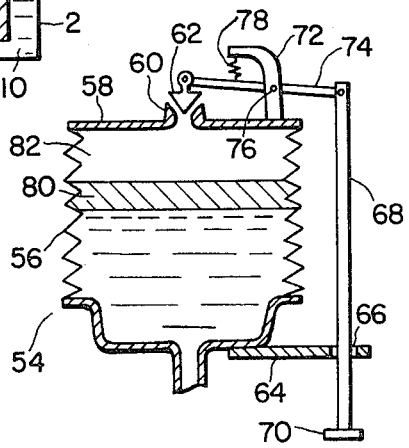
FIG. 2 is a sectional view showing another embodiment of a liquid receiver in the constant pressure type ebullient cooling equipment according to this invention.

FIG. 2 shows another embodiment of the liquid receiver. An expansion portion 56 is disposed at an upper part of the liquid receiver 54, and a lid 58 overlying the expansion portion is provided with a valve seat 60 having an aperture, in which a valve 62 is fitted. A supporting plate 64 is mounted on the bottom of the liquid receiver 54, and an aperture 66 is provided in an end part of the supporting plate 64. A link 68 is arranged to extend through the aperture 66, and a stopper 70 is disposed at the lower end of the link 68. A stanchion 72 is fixed to the lid 58, and a link 74 is attached thereto through a pin 76 as well as a spring 78. The link 74 connects the valve 62 and the link 68. As in the embodiment of FIG. 1, predetermined amounts of refrigerant liquid and sealing liquid 80 are contained in the liquid receiver 54, and an air chamber 82 is formed in the upper part of the receiver. When air exceeding a fixed amount has gathered in the air chamber 82, the expansion portion 56 extends to raise the lid 58 and to cause the stopper 70 to collide against the supporting plate 64. The valve 62 opens through the link 74 and against the force of the spring 78, so that the air is emitted to the exterior.

Figure 3:
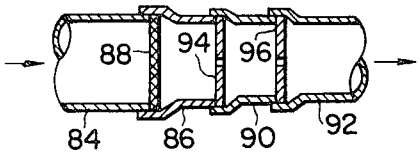
FIG. 3 is a sectional view of a throttle in the constant pressure type ebullient cooling equipment according to this invention.

FIG. 3 shows a practical embodiment of the throttle 50 in FIG. 1. An experiment has revealed that a favorable throttle through which the air is easy to pass and the refrigerant vapor is difficult to pass is one in which the resistance of fluid is proportional to the square of the flow rate, and that an orifice type throttle is recommended. Referring to FIG. 3, a filter 88 such as net and porous plate is disposed between pipes 84 and 86, and orifice plates 94 and 96 are respectively disposed between pipes 86 and 90 and between pipes 90 and 92. This throttle is a resistance unit which exploits the resistances of the orifices.

As set forth above, according to this invention, whether or not heat is generated within the vaporizer, the volume of the liquid receiver can be freely varied by the expansion portion of the liquid receiver, and hence, the cooling equipment is always operated with its internal pressure being at the atmospheric pressure. Even when large quantities of non-condensable gases such as air remain dissolved in the refrigerant liquid, these gases can be emitted from the valve at the upper part of the liquid receiver. Hence, it is unnecessary to degas the equipment in advance at the injection of the refrigerant, which facilitates the assembly of the equipment as well as the disassembly for maintenance and inspection. Since the equipment need not be put into a pressure vessel, it can be easily fabricated and can be made light in weight. Although, in the embodiment illustrated in FIG. 1, the heating unit is immersed in the liquid refrigerant within the vaporizer, it may well be held in contact with the vaporizer outside the liquid refrigerant. In this case, the assembly and handling of the heating unit are also very simple.

What we claim is:

1. A constant pressure-type ebullient cooling equipment comprising:

a vaporizer which is filled up with refrigerant liquid;

a condenser which condenses refrigerant vapor produced within said vaporizer;

a variable volume type liquid receiver which is located above said condenser and which receives the refrigerant liquid when the refrigerant vapor exists in said condenser;

coupling pipe means for, respectively, connecting said vaporizer and said condenser, and said vaporizer and said liquid receiver;

means for detecting a voluminal change in said liquid receiver and for providing an indication of said change;

outlet means for allowing escape of non-condensable gases located at an upper portion of said liquid receiver;

a valve means for emitting non-condensable gases having gathered in said liquid receiver through said outlet means, when the amount of non-condensable gases in said receiver has reached a pre-determined amount; and means for opening and shutting said valve means in response to an indication of a voluminal change in said liquid receiver from said detecting means whereby the internal pressure of said cooling equipment is held substantially constant.

2. A constant pressure type ebullient cooling equipment according to claim 1, wherein a layer of sealing liquid which has a specific gravity lower than that of the refrigerant and which does not dissolve in the refrigerant is formed on a surface of the refrigerant liquid in said liquid receiver.

3. A constant pressure type ebullient cooling equipment according to claim 1, wherein said coupling pipe means includes a pipe for connecting an upper portion of said condenser to a lower portion of said liquid receiver, and said pipe being provided with a throttle and radiation fins for cooling the refrigerant vapor having passed through said throttle.

4. A constant pressure type ebullient cooling equipment according to claim 1, further comprising means for heating the refrigerant liquid within said vaporizer to produce said refrigerant vapor.

* * * * *